US005160350A

United States Patent [19]

Stoldt

[11] Patent Number: 5,160,350

[45] Date of Patent: Nov. 3, 1992

[54] FUEL COMPOSITIONS

[75] Inventor: Stephen H. Stoldt, Concord Township, Lake County, Ohio

[73] Assignee: The Lubrizol Corporation, Wickliffe, Ohio

[21] Appl. No.: 806,808

[22] Filed: Dec. 6, 1991

Related U.S. Application Data

[63] Continuation of Ser. No. 669,561, Mar. 14, 1991, abandoned, which is a continuation of Ser. No. 148,784, Jan. 27, 1988, abandoned.

[51] Int. Cl.[5] ..... C10L 1/30

[52] U.S. Cl. ..... 44/347; 44/370; 44/385; 44/409; 44/419; 44/443; 44/451; 44/452

[58] Field of Search ..... 44/347, 353, 370, 373, 44/385, 412, 415, 434, 443, 450, 451, 452, 409, 419

[56] References Cited

U.S. PATENT DOCUMENTS

| | | | |
|---|---|---|---|
| 2,764,548 | 9/1956 | King et al. . | |
| 2,995,427 | 8/1961 | Sigworth et al. | 44/53 |
| 3,172,892 | 3/1965 | Le Suer . | |
| 3,182,019 | 5/1965 | Wilks et al. . | |
| 3,219,666 | 11/1966 | Norman . | |
| 3,272,746 | 11/1966 | Le Suer . | |
| 3,281,428 | 10/1966 | Le Suer . | |
| 3,328,284 | 6/1967 | Godar . | |
| 3,347,645 | 10/1967 | Pietsch et al. . | |
| 3,443,918 | 5/1969 | Kautsky et al. . | |
| 3,444,170 | 5/1969 | Norman et al. . | |
| 3,506,416 | 4/1970 | Patinkin . | |
| 3,649,229 | 3/1972 | Otto . | |
| 3,930,810 | 1/1976 | Gattuso . | |
| 3,948,800 | 4/1976 | Meinhardt | 44/71 |
| 3,955,938 | 5/1976 | Graham et al. . | |
| 4,083,698 | 4/1978 | Wenzel et al. . | |
| 4,240,803 | 12/1980 | Andress . | |
| 4,244,703 | 1/1981 | Kaspaul | 44/53 |
| 4,398,921 | 8/1983 | Rifkin et al. . | |
| 4,581,039 | 4/1986 | Horodysky | 44/56 |
| 4,599,088 | 7/1986 | Davis et al. | 44/51 |
| 4,659,338 | 4/1987 | Johnston | 44/68 |
| 4,684,373 | 8/1987 | Vataru et al. | 44/71 |
| 4,690,687 | 9/1987 | Johnston et al. . | |
| 4,708,809 | 11/1987 | Davis . | |

FOREIGN PATENT DOCUMENTS

| | | |
|---|---|---|
| 1098699 | 4/1981 | Canada . |
| 1188891 | 6/1985 | Canada . |
| 0086049 | 8/1983 | European Pat. Off. . |
| 0237356 | 9/1987 | European Pat. Off. . |
| 2021144 | 11/1979 | United Kingdom . |
| 2147005 | 5/1985 | United Kingdom . |
| 2177418A | 1/1987 | United Kingdom . |
| 8701126 | 2/1987 | World Int. Prop. O. . |

OTHER PUBLICATIONS

Unleaded Versus Leaded Fuel Results in Laboratory Engine Tests by E. J. Fuchs.
Chemical Abstracts, vol. 93, No. 8, Aug. 1980, p. 224, abstract 75551j.

*Primary Examiner*—Margaret Medley
*Attorney, Agent, or Firm*—Forrest L. Collins; Frederick D. Hunter; James A. Cairns

[57] ABSTRACT

This invention describes a water fix for an alcohol containing gasoline which has been formulated with a lead replacement.

22 Claims, No Drawings

FUEL COMPOSITIONS

This is a continuation of copending application Ser. No. 07/669,561 filed on Mar. 14, 1991, now abandoned which is a continuation application of Ser. No. 07/148,784 filed on Jan. 27, 1988, now abandoned.

INTRODUCTION TO THE INVENTION

This invention relates to fuel compositions for internal combustion engines which normally use low lead or unleaded gasoline. The fuels are further characterized as containing an alcohol.

The removal of lead additives, such as tetraethyl lead, from gasoline in order to reduce air pollution has led to several problems. It was found that the lead not only acted as an anti-knock agent, but was also effective in the prevention of valve seat recession. The exhaust valves in internal combustion engines generally seat against the valve seat with a slight rotary motion. The rotary motion is imparted to the valve stem during its operation to shift the relative position of the valve and to prevent uneven wear on the valve tip. With the elimination of lead additives from gasoline, it was found that a dramatic increase in the wear of the valve seats occurs. For example, see Unleaded Versus Leaded Fuel Results in Laboratory Engine Tests, E. J. Fuchs, The Lubrizol Corporation, presented at the Society of Automotive Engineers, National West Coast Meeting, Vancouver, British Columbia, Aug. 16–19, 1971 (32 pages).

Because valve seat wear is a function of engine design, load, speed conditions and operating temperature it is highly desirable that a replacement for lead be employed. The use of a lead replacement for valve seat recession is complicated by the fact that a number of newer vehicles do not require lead additives. A number of fuels on the market contain lower levels of lead and still other fuels are essentially lead-free. It is further observed that alcohol-containing fuels such as gasohol or fuels containing alcohols used to boost octane rating are also widely marketed. It, therefore, becomes desirable to obtain a gasoline composition containing a lead replacement which is capable of functioning in a multitude of gasoline based fuels.

Set out below are various references to fuels containing lead replacements and gasoline additives. U.S. Pat. No. 2,764,548 to King et al, issued Sep. 25, 1956, describes motor oils and motor fuels containing various salts of dinonylnaphthalene sulfonic acid including the sodium, potassium, calcium, barium, ammonium and amine salts. The salts are reported to be effective rust inhibitors. U.S. Pat. No. 3,506,416 to Patinkin, issued Apr. 14, 1970, describes leaded gasolines containing gasoline soluble salts of a hydroxamic acid of the formula RC(O)NHOH where R is a hydrocarbon group containing up to 30 carbon atoms. The metal may be selected from the Group Ia, IIa, IIIa, Va, Ib, IIb, IIIb, IVb, Vb, VIb, VIIb, VIII and tin. U.S. Pat. No. 3,182,019, issued to Wilks et al on May 4, 1965, describes lubricating and fuel oils including complexes which contain an alkali or alkaline earth metal carbonate in colloidal form.

The use of sodium in lead-free gasoline compositions for inhibiting valve seat recession is suggested in U.S. Pat. No. 3,955,938 to Graham et al, issued on May 11, 1976. The sodium may be incorporated into the fuel in a number of different forms such as sodium derivatives or organic compounds which are soluble, or dispersed in the gasoline. For example, simple sodium salts of an organic acid such as sodium petroleum sulfonate can be utilized although the sodium preferentially is added in the form of a sodium salt of an inorganic acid such as sodium carbonate in a colloidal dispersion in oil. Other convenient forms for introducing sodium into the fuel which are described in U.S. Pat. No. 3,955,938 include various sodium salts of sulfonic acids, sodium salts of saturated and unsaturated carboxylic acids, sodium salts of phospho-sulfurized hydrocarbons such as may be prepared by reacting $P_2S_5$ with petroleum fractions such as bright stock, and sodium salts of phenols and alkylphenols. Various optional additives described by the Graham patent include corrosion inhibitors, rust inhibitors, anti-knock compounds, anti-oxidants, solvent oils, anti-static agents, octane appreciators, e.g. t-butyl acetate, dyes, anti-icing agents, e.g. isopropanol, hexyleneglycol, ashless dispersants, detergents, and the like. The amount of sodium additive included in the fuel is an amount to provide from about 0.5 to 20, preferably 0.5 to 10 lbs. of sodium per 1000 barrels of gasoline (2.86 g/1000 liters is 1 lb/1000 bbl).

It also has been suggested that gasoline compositions can be improved by including certain detergents and dispersants. U.S. Pat. No. 3,443,918 to Kautsky et al, issued May 13, 1969, describes the addition to gasoline of mono-, bis-, or tris-alkenyl succinimides of a bis- or tris-polymethylene polyamine. These additives are reported to minimize harmful deposit formation when the fuels are used in internal combustion engines.

U.S. Pat. No. 3,172,892 to LeSuer, issued Mar. 9, 1965; U.S. Pat. No. 3,219,666 to Norman, issued Nov. 23, 1966; U.S. Pat. No. 3,272,746 to LeSuer, issued Nov. 23, 1966; U.S. Pat. No. 3,281,428 also to LeSuer, issued Oct. 25, 1966; and U.S. Pat. No. 3,444,170 to Norman et al, issued May 13, 1969 are directed to polyalkenyl succinic type ashless additives, and the Norman '170 patent teaches the use of the additive disclosed therein as a fuel detergent. U.S. Pat. No. 3,347,645 to Pietsch et al, issued Oct. 17, 1967 also describes the use of alkenyl succinimides as dispersants in gasoline, but it is there noted that the dispersants promote aqueous emulsion formation during storage and shipping. U.S. Pat. No. 3,649,229 to Otto, issued Mar. 14, 1972, teaches a fuel containing a detergent amount of a Mannich base prepared using, among other reactants, an alkenyl succinic compound. U.S. Pat. No. 4,240,803 issued to Andress on Dec. 23, 1980 also relates to hydrocarbon fuel compositions containing a detergent amount of a specific alkenyl succinimide wherein the alkenyl group is derived from a mixture of C16–28 olefins.

U.S. Patent No. 4,659,338 issued Apr. 21, 1987 to Johnston et al discloses compositions containing a hydrocarbon-soluble alkali or alkaline earth metal-containing composition and a hydrocarbon-soluble ashless dispersant. The Johnston compositions are useful for preventing valve seat recession.

British published patent application 2,177,418A published Jan. 21, 1987 discloses gasoline compositions containing a succinic acid derivative containing from 20 to 200 carbon atoms.

U.S. Pat. No. 4,708,809 issued Nov. 24, 1987 to Davis discloses lubricants suitable for two-cycle engines. It is further known from U.S. Pat. No. 4,690,687 issued Sep. 1, 1987 to Johnston et al that deposit formation within the cylinders may be avoided through a variety of means.

It has been observed that when hydrocarbon-soluble alkali metal or alkaline earth metal-containing compositions in an oxygenated fuel (alcohol-containing) are contacted with water that emulsions may form. The present invention deals with compositions which are formulated to avoid emulsion/deemulsification problems arising from the presence of water in a gasoline composition.

Throughout the specification and claims, percentages and ratios are by weight, temperatures are in degrees Celsius and pressures are in KPascals gauge unless otherwise indicated. To the extent that the references cited herein are applicable, they are herein incorporated by reference. Percentages and ratios of components are considered exemplary and may be combined.

SUMMARY OF THE INVENTION

The present invention describes a fuel composition comprising:

(A) at least one hydrocarbon-soluble or dispersible alkali metal or alkaline earth metal containing composition and, (B)(i) a hydrocarbyl substituted sulfonated phenol or salt thereof;

(B)(ii) an ethylene oxide/propylene oxide copolymer;

(C) gasoline, and (D) at least one alcohol.

The present invention further describes a composition comprising:

(A) at least one hydrocarbon-soluble or dispersible alkali metal or alkaline earth metal containing composition, (B) at least one member selected from the group consisting of (i) a hydrocarbyl substituted sulfonated phenol or salt thereof;

(ii) an ethylene oxide/propylene oxide copolymer, and (iii) a hydrocarbyl substituted phenol, and (iv) mixtures of any of (i), (ii) and (iii), (C) gasoline, and (D) at least one alcohol.

A further embodiment of the invention is a fuel composition comprising:

(B) at least one member selected from the group consisting of:

(i) a hydrocarbon substituted sulfonated phenol or salt thereof;

(ii) an ethylene oxide/propylene oxide copolymer;

(iii) a hydrocarbyl substituted phenol, and (iv) mixtures of any of (i), (ii) and (iii);

(C) gasoline;

(D) an alcohol; and, (E) at least one ashless dispersant selected from the group consisting of:

(i) at least one hydrocarbyl-substituted amine wherein the hydrocarbyl substituent is substantially aliphatic and contains at least 8 carbon atoms;

(ii) at least one acylated, nitrogen-containing compound having a substituent of at least 10 aliphatic carbon atoms made by reacting a carboxylic acid acylating agent with at least one amino compound containing at least one

—NH— group, said acylating agent being linked to said amino compound through an imido, amido, amidine, or acyloxy ammonium linkage;

(iii) at least one nitrogen-containing condensate of a phenol or aldehyde and an amino compound having at least one

—NH— group;

(iv) at least one ester of a substituted carboxylic acid;

(v) at least one polymeric dispersant;

(vi) at least one hydrocarbon substituted phenolic dispersant; and (vii) at least one fuel soluble alkoxylated derivative of an alcohol, phenol, or amine.

A still further embodiment of the present invention is a process for delivering gasoline containing an alkali metal or alkaline earth metal containing composition with enhanced water tolerance to a vehicle fuel tank including the steps of combining with the gasoline:

(A) a hydrocarbon-soluble or dispersible alkali earth metal or alkaline earth metal containing composition, and (B) at least one member selected from the group consisting of:

(i) a hydrocarbon substituted sulfonated phenol or salt thereof;

(ii) an ethylene oxide/propylene oxide copolymer;

(iii) a hydrocarbyl substituted phenol, and (iv) mixtures of (i), (ii) and (iii)

such that the weight ratio of (A) to (B) is sufficient to impart enhanced water tolerance to the mixture of (A) and (B).

DETAILED DESCRIPTION OF THE INVENTION

The following describes the components, processing and use of the compositions of the present invention.

THE ALKALI or ALKALINE EARTH METAL-CONTAINING COMPOSITION

The fuel compositions of the present invention will contain a minor amount of (A) at least one hydrocarbon-soluble alkali or alkaline earth metal-containing composition. The presence of such metal-containing compositions in the fuel compositions of the present invention provides the fuel composition with a desirable ability to prevent or minimize valve seat recession in internal combustion engines, particularly when the fuel is an unleaded or low-lead fuel. The choice of the metal does not appear to be particularly critical although alkali metals are preferred, with sodium or potassium being the preferred alkali metals.

The metal-containing composition (A) may be alkali metal or alkaline earth metal salts of sulfur acids, carboxylic acids, phenols and phosphorus acids. These salts can be neutral or basic. The former contain an amount of metal cation just sufficient to neutralize the acidic groups present in salt anion; the latter contain an excess of metal cation and are often termed overbased. These basic and neutral salts can be of oil-soluble organic sulfur acids such as sulfonic, sulfamic, thiosulfonic, sulfinic, sulfenic, partial ester sulfuric, sulfurous and thiosulfuric acid. Generally they are salts of aliphatic or aromatic sulfonic acids.

The sulfonic acids include the mono- or poly-nuclear aromatic or cycloaliphatic compounds. The sulfonic acids can be represented for the most part by the following formulae:

$$R^1(SO_3H)_r \qquad \text{Formula I}$$

$$(R^2)_xT(SO_3H)_y \qquad \text{Formula II}$$

in which T is an aromatic or cyclic nucleus such as, for example, benzene, naphthalene, anthracene, phenanthrene, diphenylene oxide, thianthrene, phenothioxine, diphenylene sulfide, phenothiazine, diphenyl oxide, diphenyl sulfide, diphenylamine, cyclohexane, petroleum naphthenes, decahydronaphthalene, cyclopentane, etc; $R^1$ and $R^2$ are each independently aliphatic groups, $R^1$ contains at least about 15 carbon atoms, the sum of the carbon atoms in $R^2$ and T is at least about 15, and r, x and y are each independently 1 or greater.

Specific examples of $R^1$ are groups derived from petrolatum, saturated and unsaturated paraffin wax, and polyolefins, including polymerized $C_2$, $C_3$, $C_4$, $C_5$, $C_6$, etc., olefins containing from about 15 to 7000 or more carbon atoms. The groups T, $R^1$ and $R^2$ in the above formulae can also contain other inorganic or organic substituents in addition to those enumerated above such as, for example, hydroxy, mercapto, halogen, nitro, amino, nitroso, sulfide, disulfide, etc. The subscript x is generally 1–3, and the subscripts r+y generally have an average value of about 1–4 per molecule.

The following are specific examples of oil soluble sulfonic acids coming within the scope of Formulae I and II above, and it is to be understood that such examples serve also to illustrate the salts of such sulfonic acids useful in this invention. In other words, for every sulfonic acid enumerated it is intended that the corresponding neutral and basic metal salts thereof are also understood to be illustrated. Such sulfonic acids are mahogany sulfonic acids; bright stock sulfonic acids; sulfonic acids derived from lubricating oil fractions having a Saybolt viscosity from about 100 seconds at 100° F. (37.7° C.) to about 200 seconds at 210° F. (99° C.); petrolatum sulfonic acids; mono- and poly-wax substituted sulfonic and polysulfonic acids of, e.g., benzene, diphenylamine, thiophene, alpha-chloronaphthalene, etc.; other substituted sulfonic acids such as alkyl benzene sulfonic acids (where the alkyl group has at least 8 carbons), cetylphenol mono-sulfide sulfonic acids, dicetyl thianthrene disulfonic acids, dilauryl beta naphthyl sulfonic acids, and alkaryl sulfonic acids such as dodecyl benzene "bottoms" sulfonic acids.

The latter are acids derived from benzene which has been alkylated with propylene tetramers or isobutene trimers to introduce 1, 2, 3 or more branched-chain $C_{12}$ substituents on the benzene ring. Dodecyl benzene bottoms, principally mixtures of mono- and di-dodecyl benzenes, are available as by-products from the manufacturer of household detergents. Similar products obtained from alkylation bottoms formed during manufacture of linear alkyl sulfonates (LAS) are also useful in making the sulfonates used in this invention.

The production of sulfonates from detergent manufacture by-products by reaction with, e.g., $SO_3$, is well known to those skilled in the art. See, for example, the article "Sulfonates" in Kirk-Othmer "Encyclopedia of Chemical Technology", Second Edition, Vol. 19, pp. 291 et seq. published by John Wiley & Sons, N.Y. (1969).

Other descriptions of neutral and basic sulfonate salts and techniques for making them can be found in the following U.S. Pat. Nos.: 2,174,110; 2,174,506; 2,174,508; 2,193,824; 2,197,800; 2,202,781; 2,212,786; 2,213,360; 2,228,598; 2,223,676; 2,239,974; 2,263,312; 2,276,090; 2,276,097; 2,315,514; 2,319,121; 2,321,022; 2,333,568; 2,333,788; 2,335,259; 2,337,552; 2,347,568; 2,366,027; 2,374,193; 2,383,319; 3,312,618; 3,471,403; 3,488,284; 3,595,790 and 3,798,012. These are hereby incorporated by reference for their disclosures in this regard.

With respect to the sulfonic acids or salts thereof described herein and in the appended claims, it is intended herein to employ the term "petroleum sulfonic acids" or "petroleum sulfonates" to cover all sulfonic acids or the salts thereof derived from petroleum products. A particularly valuable group of petroleum sulfonic acids are the mahogany sulfonic acids (so called because of their reddish-brown color) obtained as a by-product from the manufacturer of petroleum white oils by a sulfuric acid process.

The carboxylic acids from which suitable neutral and basic alkali metal and alkaline earth metal salts for use in this invention can be made include aliphatic, cycloaliphatic, and aromatic mono and polybasic carboxylic acids such as the naphthenic acids, alkyl- or alkenyl-substituted cyclopentanoic acids, the corresponding cyclohexanoic acids and the corresponding aromatic acids. The aliphatic acids generally contain at least eight carbon atoms and preferably at least twelve carbon atoms. Usually they have no more than about 400 carbon atoms. Generally, if the aliphatic carbon chain is branched, the acids are more oil soluble for any given carbon atom content. The cycloaliphatic and aliphatic carboxylic acids can be saturated or unsaturated. Specific examples include 2-ethylhexanoic acid, alpha-linolenic acid, behenic acid, isostearic acid, pelargonic acid, capric acid, palmitoleic acid, linoleic acid, lauric acid, oleic acid, ricinoleic acid, undecylic acid, dioctylcyclopentane carboxylic acid, myristic acid, dilauryldecahydronaphthalene carboxylic acid, stearyl-octahydroindene carboxylic acid, palmitic acid, commercially available mixtures of two or more carboxylic acids such as tall oils acids, rosin acids, and the like. A group of oil-soluble carboxylic acids useful in preparing the salts used in the present invention are the oil-soluble aromatic carboxylic acids. These acids are represented by the general formula:

$$(R^*)_aAr^*(CXXH)_m \qquad \text{Formula III}$$

where R* is a hydrocarbyl (preferably aliphatic hydrocarbon-based) group of at least four carbon atoms, and no more than about 400 aliphatic carbon atoms, a is an integer of from one to four, Ar* is a polyvalent aromatic hydrocarbon nucleus of up to about 14 carbon atoms, each X is independently a sulfur or oxygen atom, and m is an integer of from one to four with the proviso that R* and a are such that there is an average of at least 8 aliphatic carbon atoms provided by the R* groups for each acid molecule represented by Formula III. Examples of aromatic nuclei represented by the variable Ar* are the polyvalent aromatic radicals derived from benzene, naphthalene, anthracene, phenanthrene, indene, fluorene, biphenyl, and the like. Generally, the radical represented by Ar* will be a polyvalent nucleus derived from benzene or naphthalene such as phenylenes and naphthlene, e.g., methyl-phenylenes, ethoxyphenylenes, nitrophenylenes, isopropyl-phenylenes, hydroxyphenylenes, mercaptophenylenes, N,N-diethylaminophenylenes, chlorophenylenes, dipropoxynaphthylenes, triethylnaphthylenes, and similar tri-, tetra-, pentavalent nuclei thereof, etc.

The R* groups are usually purely hydrocarbyl groups, preferably groups such as alkyl or alkenyl radicals. However, the R* groups can contain a small number substituents such as phenyl, cycloalkyl (e.g., cyclohexyl, cyclopentyl, etc.) and nonhydrocarbon groups such as nitro, amino, halo (e.g., chloro, bromo, etc.) lower alkoxy, lower alkyl mercapto, oxo substituents (i.e.,=O), thio groups (i.e.,=S), interrupting groups such as —NH—, —O—, —S—, and the like provided the essentially hydrocarbon character of the R* group is retained. The hydrocarbon character is retained for purposes of this invention so long as any non-carbon atoms present in the R* group do not account for more than about 10% of the total weight of the R* groups.

Examples of R* groups include butyl, isobutyl, pentyl, octyl, nonyl, dodecyl, docosyl, tetracontyl, 5-chlorohexyl, 4-ethoxypentyl, 2-hexenyl, cyclohexyloctyl, 4-(p-chlorophenyl)-octyl, 2,3,5-trimethylheptyl, 2-ethyl-5-methyloctyl, and substituents derived from polymerized olefins such as polychloroprenes, polyethylenes, polypropylenes, polyisobutylenes, ethylene-propylene copolymers, chlorinated olefin polymers, oxidized ethylene-propylene copolymers, and the like. Likewise, the group Ar may contain non-hydrocarbon substituents, for example, such diverse substituents as lower alkoxy, lower alkyl mercapto, nitro, halo, alkyl or alkenyl groups of less than four carbon atoms, hydroxy, mercapto and the like.

A group of particularly useful carboxylic acids are those of the formula:

$$R^*_a Ar^* (CXXH)_m (XH)_p \qquad \text{Formula IV}$$

where R*, X, Ar*, m and a are as defined in Formula III and p is an integer of 1 to 4, usually 1 or 2. Within this group, an especially preferred class of oil-soluble carboxylic acids are those of the formula:

$$(R^{**})Ph_a(COOH)_b(OH)_c \qquad \text{Formula V}$$

where R in Formula V is an aliphatic hydrocarbon group containing at least 4 to about 400 carbon atoms, Ph is a phenyl group, a is an integer of from 1 to 3, b is 1 or 2, c is zero, 1, or 2 and preferably 1 with the proviso that R and a are such that the acid molecules contain at least an average of about twelve aliphatic carbon atoms in the aliphatic hydrocarbon substituents per acid molecule. And within this latter group of oil-soluble carboxylic acids, the aliphatic-hydrocarbon substituted salicylic acids wherein each aliphatic hydrocarbon substituent contains an average of at least about sixteen carbon atoms per substituent and one to three substituents per molecule are particularly useful. Salts prepared from such salicylic acids wherein the aliphatic hydrocarbon substituents are derived from polymerized olefins, particularly polymerized lower 1-mono-olefins such as polyethylene, polypropylene, polyisobutylene, ethylene/propylene co-polymers and the like and having average carbon contents of about 30 to 400 carbon atoms.

The carboxylic acids corresponding to Formulae III and IV above are well known or can be prepared according to procedures known in the art. Carboxylic acids of the type illustrated by the above formulae and processes for preparing their neutral and basic metal salts are well known and disclosed, for example, in such U.S. Pat. Nos. as 2,197,832; 2,197,835; 2,252,662; 2,252,664; 2,714,092; 3,410,798 and 3,595,791.

Another type of neutral and basic carboxylate salt used in this invention are those derived from alkenyl succinates of the general formula:

$$R^*CH(COOH)CH_2COOH \qquad \text{Formula VI}$$

wherein R* is as defined above in Formula III. Such salts and means for making them are set forth in U.S. Pat. Nos. 3,271,130; 3,567,637 and 3,632,610. Generally, the molecular weight of the polybasic carboxylates (polycarboxylates) will be about 400 to about 2000, preferably about 500 to about 1500. Such molecular weights will correspond to about 28 to about 145, preferably about 35 to about 110 carbon atoms in the hydrocarbon chain of the molecule. One such acid is propylene tetramer-substituted maleic acid. Other patents specifically describing techniques for making basic salts of the hereinabove-described sulfonic acids, carboxylic acids, and mixtures of any two or more of these include U.S. Pat. Nos. 2,501,731; 2,616,904; 2,616,905; 2,616,906; 2,616,911; 2,616,924; 2,616,925; 2,617,049; 2,777,874; 3,027,325; 3,256,186; 3,282,835; 3,384,585; 3,373,108; 3,368,396; 3,342,733; 3,320,162; 3,312,618; 3,318,809; 3,471,403; 3,488,284; 3,595,790 and 3,629,109.

Neutral and basic salts of phenols (generally known as phenates) are also useful in the compositions of this invention and well known to those skilled in the art. The phenols from which these phenates are formed are of the general formula:

$$(R^*)_a—(Ar^*)—(OH)_m \qquad \text{Formula VII}$$

wherein R*, a, Ar*, and m have the same meaning and preferences as described hereinabove with reference to Formula III. The same examples described with respect to Formula III also apply.

The commonly available class of phenates are those made from phenols of the general formula:

$$(R')_a(R^4)_z\, Ph(OH)_b \qquad \text{Formula VIII}$$

wherein a is an integer of 1–3, b is of 1 or 2, z is 0 or 1, Ph is a phenyl group R' in Formula VIII is a substantially saturated hydrocarbon-based substituent having an average of from about 30 to about 400 aliphatic carbon atoms and $R^4$ is selected from the group consisting of lower alkyl, lower alkoxyl, nitro, and halo groups.

One particular class of phenates for use in this invention are the basic (i.e., overbased, etc.) alkali and alkaline earth metal sulfurized phenates made by sulfurizing a phenol and described hereinabove with a sulfurizing agent such as sulfur, a sulfur halide, or sulfide or hydrosulfide salt. Techniques for making these sulfurized phenates are described in U.S. Pat. Nos. 2,680,096; 3,036,971 and 3,775,321.

Other phenates that are useful are those that are made from phenols that have been linked through alkylene (e.g., methylene) bridges. These are made by reacting single or multi-ring phenols with aldehydes or ketones, typically, in the presence of an acid or basic catalyst. Such linked phenates as well as sulfurized phenates are described in detail in U.S. Pat. No. 3,350,038; particularly columns 6–8 thereof.

Alkali and alkaline earth metal salts of phosphorus acids also are useful in the fuel compositions of the invention. For example, the normal and basic salts of the phosphonic and/or thiophosphonic acids prepared by reacting inorganic phosphorus reagents such as $P_2S_5$ with petroleum fractions such as bright stock or polyolefins obtained from olefins of 2 to 6 carbon atoms. Particular examples of the polyolefins are polybutenes having a molecular weight of from 700 to 100,000. Other phosphorus-containing reagents which have been reacted with olefins include phosphorus trichloride or phosphorus trichloride-sulfur chloride mixture, (e.g., U.S. Pat. Nos. 3,001,981 and 2,195,517), phosphites and phosphite chlorides (e.g., U.S. Pat. Nos. 3,033,890 and 2,863,834), and air or oxygen with a phosphorus halide (e.g., U.S. Pat. No. 2,939,841).

Mixtures of two or more neutral and basic salts of the hereinabove described organic sulfur acids, carboxylic acids, phosphorus acids and phenols can be used in the compositions of this invention. As mentioned above, the amount of alkali or alkaline earth metal containing composition (A) included in the fuel composition will be an amount which is sufficient to provide from about 1 to about 100 parts per million of the alkali metal or alkaline earth metal in the fuel composition. When utilized in lead free or low lead fuels, the amount of alkali metal or alkaline earth metal-containing composition (A) included in the fuel is an amount which is sufficient to reduce valve seat recession when the fuel is used in an internal combustion engine.

The following specific illustrative examples describe the preparation of exemplary alkali and alkaline earth metal compositions (A) useful in the fuel compositions of this invention.

EXAMPLE A-1

A mixture of 1000 parts of a primary branched monoalkyl benzene sulfonic acid (M.W., approximately 522) in 637 parts of mineral oil is neutralized with 145.7 parts of a 50% caustic soda solution and the excess water and caustic removed. The product containing the sodium salt obtained in this manner contains 2.5% sodium and 3.7% sulfur.

EXAMPLE A-2

The procedure of Example A-1 is repeated except that the caustic soda is replaced by a chemically equivalent amount of $Ca(OH)_2$.

EXAMPLE A-3

The procedure of Example A-1 is repeated except that the caustic soda is replaced by a chemically equivalent amount of KOH.

EXAMPLE A-4

A mixture of 906 parts of an alkyl phenyl sulfonic acid (having an average molecular weight of 450, vapor phase osmometry), 564 parts mineral oil, 600 parts toluene, 98.7 parts magnesium oxide and 120 parts water is blown with carbon dioxide at a temperature of 78°-85° C. for seven hours at a rate of about 3 cubic feet of carbon dioxide per hour (85 l/hr). The reaction mixture is constantly agitated throughout the carbonation. After carbonation, the reaction mixture is stripped to 165° C./20 torr (2.65 KPa) and the residue filtered. The filtrate is an oil solution of the desired overbased magnesium sulfonate having a metal ratio of about 3.

EXAMPLE A-5

A mixture of 323 parts of mineral oil, 4.8 parts of water, 0.74 parts of calcium chloride, 79 parts of lime, and 128 parts of methyl alcohol is prepared, and warmed to a temperature of about 50° C. To this mixture there is added with mixing, 1000 parts of an alkyl phenyl sulfonic acid having an average molecular weight (vapor phase osmometry) of 500. The mixture then is blown with carbon dioxide at a temperature of about 50° C. at the rate of about 5.4 lbs. per hour (40.8 g/minute) for about 2.5 hours. After carbonation, 102 additional parts of oil are added and the mixture is stripped of volatile materials at a temperature of about 150°-155° C. at 55 mm (7.3 KPa) pressure. The residue is filtered and the filtrate is the desired oil solution of the overbased calcium sulfonate having calcium content of about 3.7% and a metal ratio of about 1.7.

THE WATER FIX

The second component of the invention (B) is at least one member selected from the group consisting of:

(i) a hydrocarbyl substituted sulfonated phenol or salt thereof;

(ii) an ethylene oxide/propylene oxide copolymer, and (iii) a hydrocarbyl substituted phenol, or (iv) mixtures of (i), (ii) and (iii).

Component (B)(i) may be obtained by preparing the sulfonic acid of (B)(iii) or the salt of the sulfonic acid of B (iii). An ample disclosure of the sulfonic acids and sulfonates is found in the description of component (A). The cationic portion of (B)(i) is preferably ammonium. When a phenol is employed as the aromatic nucleus in (A), the hydrocarbyl substituted phenol sulfonic acid or salt (B)(i) is obtained.

The second item under (B) is an ethylene oxide/propylene oxide copolymer. Such materials are well known in the art and are obtained by reacting ethylene oxide or a polymer of ethylene oxide with propylene oxide or a polymer of propylene oxide. It is first possible to obtain a random polymer of ethylene oxide and propylene oxide by simply charging the desired quantities of each material and conducting the polymerization as is known in the art. It is also possible to prepolymerize ethylene oxide to a desired chain length and then to further react the ethylene oxide by capping with propylene oxide.

It is further possible to polymerize the propylene oxide to the desired molecular weight and to then terminate the propylene oxide polymer with ethylene oxide. Of course, the propylene oxide may be polymerized and then reacted with an ethylene oxide polymer. The molecular weight of (B)(ii) is conveniently about 400 to 10,000, preferably 600 to 5,000.

It is desirable that the weight percent of the ethylene oxide in the copolymer is from 10 to 90 percent, preferably 15 to 90 percent by weight of the copolymer. It is, of course, recognized that as ethylene oxide has a lower molecular weight than propylene oxide that a greater number of equivalents of ethylene oxide will be utilized on a equivalent basis than of the propylene oxide.

Component (iii) is a hydrocarbon substituted phenol. The hydrocarbon substituted phenol generally corresponds to component (B)(i) the hydrocarbyl substituted sulfonated phenol or salt thereof. Thus, component (B) (iii) is usually the raw material for component (B) (i) and is commercially available. When mixtures of (B) (i) and (B) (iii) are desired, it is possible to under-sulfonate the hydrocarbon substituted phenol. Either of components (B)(i) or (iii) will typically contain about 10 to about 30 carbon atoms on the hydrocarbyl chain on average, preferably about 14 to about 26 carbon atoms.

The hydrocarbyl substituted phenol may also be crosslinked through the use of formaldehyde to give a polymeric structure. That is, the hydrocarbyl substituted phenol is crosslinked at the ortho (and often para position) to the hydroxyl groups. It is further possible to alkoxylate the phenol. In this regard, the reader's attention is directed to the discussion of ethylene oxide and propylene oxide given above. Each of the foregoing materials may be condensed onto the hydroxyl group of the phenol whether polymeric or monomeric.

It is further possible, as component (B)(iv), to utilize a mixture of any of the foregoing components designated as component (B). A preferred species of component (B) is, in fact, such a mixture.

When component (B) is (iv), it is desired that the weight ratio of component (i) to (ii) is from about 10:1 to about 1:10, preferably about 5:1 to about 1:5. The weight ratio of (B)(i) to (B)(iii) is typically from about 8:1 to about 1:8, preferably about 5:1 to about 1:5. The desired ratio of component (B)(ii) to (iii) is typically about 7:1 to about 1:7, preferably 4:1 to about 1:4. When two of the three individual components of (B) are employed, the ratios are also as described above.

THE GASOLINE COMPONENT

The gasoline component (C) useful in the present invention is obtained as a hydrocarbon distillate. Gasolines are supplied in a number of different grades depending on the type of service for which they are intended. The gasolines utilized in the present invention include those designed as motor and aviation gasolines. Motor gasolines include those defined by ASTM specification D-439-73 and are composed of a mixture of various types of hydrocarbons including aromatics, olefins, paraffins, isoparaffins, naphthenes and occasionally diolefins. Motor gasolines normally have a boiling range within the limits of about 20° C. to 230° C. while aviation gasolines have narrower boiling ranges, usually within the limits of about 37° C. to 165° C.

The gasoline may have any of the typically added ingredients provided that there are no adverse effects to obtaining performance for valve seat recession, obtaining the desired water fix, and which do not cause a substantial reduction of the octane value of the gasoline.

One such ingredient which is typically included in gasoline is lead in the form of a compound such as tetraethyl lead or tetramethyl lead. It is first noted that lead is being regulated out of gasoline in many countries. Those countries still allowing some amounts of lead in the gasoline allow "low-lead" formulations. Typically, a low-lead gasoline contains less than about 0.5 gram of lead per gallon of fuel. This invention is concerned in one aspect with low-lead fuels containing as little as 0.1 gram of lead per gallon (0.0264 g/liter) of gasoline.

It is further preferred in the present invention that the gasoline be lead-free. By lead-free it is meant that small trace amounts of lead, significantly less than the amounts in a low-lead fuel, are tolerated. That is, no-lead or lead-free gasoline compositions occasionally contain trace amounts of lead due to contamination by leaded fuels. Thus, the term no-lead or lead-free gasolines includes very small amounts of lead; however, it is preferred that the end gasoline product be completely lead-free.

A further typical ingredient which is included with gasoline is a scavenger to remove or reduce engine deposits. Typically, the scavenger will be ethylene dichloride or ethylene dibromide or mixtures thereof. For a further discussion of scavengers useful in the compositions of the present invention, the reader is directed to U.S. Pat. No. 4,690,687 issued Sep. 1, 1987 to Johnston et al which is herein incorporated by reference.

THE ALCOHOL

Alcohols (D) which are used in the present invention are typically those which are normally added to gasoline. The use of alcohols in gasolines is primarily for three purposes. The first purpose is as a partial fuel substitute for the hydrocarbons present in the gasoline to extend the supply of the petroleum hydrocarbons. In this regard, methanol and ethanol are typically utilized as partial replacements for the hydrocarbon source in gasoline.

The second group of alcohols often used in fuels are those alcohols which have utility as an octane enhancer. Typically, the octane enhancer alcohols will be materials such as methanol, ethanol, isopropanol, t-amyl alcohol and t-butanol. Such alcohols aid in the combustion of the hydrocarbon source and promote the clean burning of the fuel in the internal combustion engine cylinders, thereby increasing power output.

The third use of alcohols in gasoline is to reduce levels of certain emissions. Such emissions include evaporative or exhaust emissions which lead to photochemical smog. The alcohols described immediately above have such uses.

Overall, the alcohols which are typically employed in the present invention contain up to about 8 carbon atoms, preferably from about 1 to about 6 carbon atoms. The preferred alcohols for gasahol production are methanol and ethanol. The preferred alcohols for octane enhancement are tertiary alcohols. Thus, t-butanol is a preferred octane enhancer. An especially preferred combination of alcohols for use in octane enhancement is a mixture of t-butanol and methanol, particularly in a weight ratio to one another of 10:1 to 1:10, preferably about 5:1 to about 1:5.

The level of usage of the alcohols in the present invention is typically from about 0.1 percent to about 45 percent by weight of the total gasoline composition. More typically, the amount of alcohol present will be from about 0.5 percent to about 15 percent by weight of the total gasoline composition.

The preferred alcohols for use in gasoline compositions of the present invention are monohydric alcohols.

THE DISPERSANT

The fuel compositions of the present invention desirably also contain a minor amount of (E) at least one hydrocarbon soluble ashless dispersant. The compounds useful as ashless dispersants generally are characterized by a "polar" group attached to a relatively high molecular weight hydrocarbon chain. The "polar" group generally contains one or more of the elements nitrogen, oxygen and phosphorus. The solubilizing chains are generally higher in molecular weight than those employed with the metallic types, but in some instances they may be quite similar.

In general, any of the ashless detergents which are known in the art for use in lubricants and fuels can be utilized in the fuel compositions of the present invention.

In one embodiment of the present invention, the dispersant is selected from the group consisting of (i) at least one hydrocarbyl-substituted amine wherein the hydrocarbyl substituent is substantially aliphatic and contains at least 8 carbon atoms;

(ii) at least one acylated, nitrogen-containing compound having a substituent of at least 10 aliphatic carbon atoms made by reacting a carboxylic acid acylating agent with at least one amino compound containing at least one

—NH— group, said acylating agent being linked to said amino compound through an imido, amido, amidine, or acyloxy ammonium linkage;

(iii) at least one nitrogen-containing condensate of a phenol, aldehyde and amino compound having at least one

—NH— group;

(iv) at least one ester of a substituted carboxylic acid;

(v) at least one polymeric dispersant;

(vi) at least one hydrocarbon substituted phenolic dispersant; and (vii) at least one fuel soluble alkoxylated derivative of an alcohol, phenol or amine.

The following specific examples illustrate the preparation of exemplary dispersants useful in the fuel compositions of this invention.

EXAMPLE E-1

A mixture of 1500 parts of chlorinated poly(isobutene) having a molecular weight of about 950 and a chlorine content of 5.6%, 285 parts of an alkylene polyamine having an average composition corresponding stoichiometrically to tetraethylene pentamine and 1200 parts of benzene is heated to reflux. The temperature of the mixture is then slowly increased over a 4-hour period to 170° C. while benzene is removed. The cooled mixture is diluted with an equal volume of mixed hexanes and absolute ethanol (1:1). The mixture is heated to reflux and ⅓ volume of 10% aqueous sodium carbonate is added to the mixture. After stirring, the mixture is allowed to cool and phase separate. The organic phase is washed with water and stripped to provide the desired polyisobutenyl poly-amine having a nitrogen content of 4.5% by weight.

EXAMPLE E-2

A mixture of 140 parts of toluene and 400 parts of a polyisobutenyl succinic anhydride (prepared from the poly(isobutene) having a molecular weight of about 850, vapor phase osmometry) having a saponification number 109, and 63.6 parts of an ethylene amine mixture having an average composition corresponding in stoichiometry to tetraethylene pentamine, is heated to 150° C. while the water/toluene azeotrope is removed. The reaction mixture is then heated to 150° C. under reduced pressure until toluene ceases to distill. The residual acylated polyamine has a nitrogen content of 4.7% by weight.

EXAMPLE E-3

To 1,133 parts of commercial diethylene triamine heated at 110°-150° C. is slowly added 6820 parts of isostearic acid over a period of two hours. The mixture is held at 150° C. for one hour and then heated to 180° C. over an additional hour. Finally, the mixture is heated to 205° C. over 0.5 hour; throughout this heating, the mixture is blown with nitrogen to remove volatiles. The mixture is held at 205°-230° C. for a total of 11.5 hours and the stripped at 230° C./20 torr (2.65KPa) to provide the desired acylated polyamine as residue containing 6.2% nitrogen by weight.

EXAMPLE E-4

To a mixture of 50 parts of a polypropyl-substituted phenol (having a molecular weight of about 900, vapor phase osmometry), 500 parts of mineral oil (a solvent refined paraffinic oil having a viscosity of 100 SUS at 100° F.) and 130 parts of 9.5% aqueous dimethylamine solution (equivalent to 12 parts amine) is added dropwise, over an hour, 22 parts of a 37% aqueous solution of formaldehyde (corresponding to 8 parts aldehyde). During the addition, the reaction temperature is slowly increased to 100° C. and held at that point for three hours while the mixture is blown with nitrogen. To the cooled reaction mixture is added 100 parts toluene and 50 parts mixed butyl alcohols. The organic phase is washed three times with water until neutral to litmus paper and the organic phase filtered and stripped to 200° C./5-10 (0.66-1.33 KPa) torr. The residue is an oil solution of the final product containing 0.45% nitrogen by weight.

EXAMPLE E-5

A mixture of 140 parts of a mineral oil, 174 parts of a poly(isobutene)-substituted succinic anhydride (molecular weight 1000) having a saponification number of 105 and 23 parts of isostearic acid is prepared at 90° C. To this mixture there is added 17.6 parts of a mixture of polyalkylene amines having an overall composition corresponding to that of tetraethylene pentamine at 80°-100° C. throughout a period of 1.3 hours. The reaction is exothermic. The mixture is blown at 225° C. with nitrogen at a rate of 5 pounds (2.27 Kg) per hour for 3 hours whereupon 47 parts of an aqueous distillate is obtained. The mixture is dried at 225° C. for 1 hour, cooled to 100° C. and filtered to provide the desired final product in oil solution.

EXAMPLE E-6

A substantially hydrocarbon-substituted succinic anhydride is prepared by chlorinating a polyisobutene having a molecular weight of 1000 to a chlorine content of 4.5% and then heating the chlorinated polyisobutene with 1.2 molar proportions of maleic anhydride at a temperature of 150°-220° C. The succinic anhydride thus obtained has an acid number of 130. A mixture of 874 grams (1 mole) of the succinic anhydride and 104 grams (1 mole) of neopentyl glycol is mixed at 240°-250° C./30 mm (4 KPa) for 12 hours. The residue is a mixture of the esters resulting from the esterification of one and/or both hydroxy radicals of the glycol. It has a saponification number of 101 and an alcoholic hydroxyl content of 0.2% by weight.

EXAMPLE E-7

The dimethyl ester of the substantially hydrocarbon-substituted succinic anhydride of Example B-2 is prepared by heating a mixture of 2185 grams of the anhydride, 480 grams of methanol, and 1000 cc. of toluene at 50°-65° C. while hydrogen chloride is bubbled through the reaction mixture for 3 hours. The mixture is then heated at 60°-65° C. for 2 hours, dissolved in benzene, washed with water, dried and filtered. The filtrate is heated at 150° C./60 mm (8 KPa) to rid it of volatile components. The residue is the defined dimethyl ester.

EXAMPLE E-8

A carboxylic acid ester is prepared by slowly adding 3240 parts of a high molecular weight carboxylic acid (prepared by reacting chlorinated polyisobutylene and acrylic acid in a 1:1 equivalent ratio and having an average molecular weight of 982) to a mixture of 200 parts of sorbitol and 100 parts of diluent oil over a 1.5-hour period while maintaining a temperature of 115°-125° C. Then 400 parts of additional diluent oil are added and the mixture is maintained at about 195°-205° C. for 16 hours while blowing the mixture with nitrogen. An additional 755 parts of oil are then added, the mixture cooled to 140° C., and filtered. The filtrate is an oil solution of the desired ester.

EXAMPLE E-9

An ester is prepared by heating 658 parts of a carboxylic acid having an average molecular weight of 1018 (prepared by reacting chlorinated polyisobutene with acrylic acid) with 22 parts of pentaerythritol while maintaining a temperature of about 180°-205° C. for about 18 hours during which time nitrogen is blown through the mixture. The mixture is then filtered and the filtrate is the desired ester.

Further information on dispersants may be obtained from U.S. Pat. No. 4,690,687 issued Sep. 1, 1987 which is herein incorporated by reference.

AMOUNT OF THE COMPONENTS

The amount of the hydrocarbon-soluble or dispersible alkali metal or alkaline earth metal-containing composition (A) to the water fix (B) is typically about 1:2 to about 50:1, preferably 1:1 to about 40:1. The weight ratio of the water fix (B) to the ashless dispersant (E) is typically from about 2:1 to about 1:50, preferably about 1:1 to about 1:40.

The amount of the ashless dispersant (E) to the gasoline is typically about 25 parts to about 500 parts, more preferably about 35 parts to 400 parts by weight of the dispersant per million parts of fuel. The weight ratio of the hydrocarbon-soluble or dispersible alkali metal or alkaline earth metal-containing composition (A) to the ashless dispersant (E) is typically from about 4:0.1 to about 1:4.

The amount of the hydrocarbon soluble alkali or alkaline earth metal-containing composition (A) included in the fuel compositions of the present invention may vary over a wide range although it is preferred not to include unnecessarily large excesses of the metal composition. The amount included in the fuel should be an amount sufficient to improve the desired properties such as the reduction of valve seat recession when the fuel is burned in internal combustion engines which are not designed for use with unleaded gas. For example, older engines which were designed for leaded fuels were not constructed with specially hardened valve seats. Accordingly, the amount of metal composition to be included in the fuel will depend in part on the amount of lead in the fuel. For unleaded fuels, large amounts of the metal composition are required to provide the desirable reduction in valve seat recession. When low-lead fuels are treated in accordance with the present invention, lesser amounts of the metal-containing composition generally are required.

In summary, the amount of component (A) included in the fuel compositions of the present invention will be an amount which is sufficient to reduce valve seat recession when such fuels are utilized in an internal combustion engine. Generally, the fuel will contain less than about 2.0 gram, preferably less than 1.0 gram of the alkali or alkaline earth metal compound per liter of fuel. In another embodiment, the fuel composition of the present invention will contain from about 1 to about 100 parts of the alkali metal or alkaline earth metal per million parts of fuel although amounts of from 5 to about 60 parts per million appear to be adequate for most applications.

The amount of the hydrocarbon-soluble ashless dispersant optionally included in the fuel compositions of this invention also can vary over a wide range. Typically, the weight ratio of (B) the water fix to (E) the dispersant will be 2:1 to 1:50, preferably 1:1 to 1:40. The amount of (E) will depend in part on the amount of the metal-containing composition (A). Typically the ashless dispersant (E) is used at about 4:0.1 to about 1:10 by weight to (A). The amount of the ashless dispersant to be included in the particular fuel composition can be determined readily by one skilled in the art and, obviously, the amount of dispersant contained in the fuel should not be so high as to have deleterious effects such as forming deposits on engine parts when the engine is cooled.

The following is an exemplification of the present invention.

EXAMPLE 1

48.8 parts of mineral oil are added to a mixing vat having stirring capacity. A mixture of 0.6 parts of a $C_{24}$ alkylphenol sulfonate ammonium salt and 0.3 parts of a polyethylene glycol/polypropylene glycol copolymer having a molecular weight of 600 is added to the mixture. The copolymer is approximately 1:1 weight ratio of the monomers. A $C_{24}$ substituted phenol is added at 0.3 parts by weight.

To the foregoing mixture is added 8.4 parts of the ashless dispersant obtained from Example E-2. A fluidizing oil (high viscosity mineral oil) is added at 8 parts by weight. Lastly, 33.6 parts by weight of the active ingredient obtained from Example A-1 are added to the mixture with stirring.

The foregoing mixture is added at 250 PTB (pounds per thousand barrels or 0.71 g/l) to oxygenated gasoline as described below. The hydrocarbon component of the gasoline is 93.8%. The methanol is 3.89% and the t-butanol is 2.4% by weight. The respective volume ratio is 95:3:2.

The gasoline fuel is observed to have a high degree of water tolerance, e.g., any emulsification is quickly broken with substantially complete separation into an organic and a water phase. The product also functions to protect exhaust valve seats.

EXAMPLE 2

This composition is formulated identically to Example 1, however, replacement of the sodium alkylbenzene sulfonate salt with an equivalent amount (on a sodium basis) of the neutral sodium salt of polyisobutylene succinic acid is employed. The molecular weight of the anionic portion of the succinic acid salt is 950 and is obtained according to U.S. Pat. No. 3,271,370 issued to Le Suer, Sep. 6, 1966.

The product is otherwise obtained as previously described in Example 1 and blended at the same level in gasoline. The product functions as an aid against valve seat recession and is observed to break aqueous emulsions rapidly.

What is claimed is:

1. A fuel composition comprising:

(A) at least one hydrocarbon-soluble or dispersible alkali metal or alkaline earth metal containing composition, (B) a mixture of:

(i) a hydrocarbyl substituted sulfonated phenol or salt thereof;

(ii) an ethylene oxide/propylene oxide copolymer, and (iii) a hydrocarbyl substituted phenol, the weight ratio of component (B) (i) to (B) (ii) is from about 10:1 to about 1:10 and the weight ratio of component (B) (i) to (B) (iii) is from about 8:1 to about 1:8

(C) low lead or no lead gasoline, and (D) at least on alcohol wherein the alcohol is monohydric containing up to 8 carbon atoms.

2. The composition of claim 1, wherein (A) is an aromatic sulfonate.

3. The composition of claim 2, wherein (A) the aromatic surface is the sodium salt.

4. The composition of claim 1, wherein (A) is a polycarboxylate salt.

5. The composition of claim 4, wherein the polycarboxylate salt (A) is a hydrocarbyl substituted alkali metal succinate.

6. The composition of claim 1, wherein the hydrocarbyl chain on the hydrocarbyl substituted sulfonated phenol contains an average of about 10 to about 30 carbon atoms.

7. The composition of claim 1, additionally comprising:

(E) an ashless dispersant selected from the group consisting of;

(i) at least one hydrocarbyl-substituted amine wherein the hydrocarbyl substituent is aliphatic and contains at least 8 carbon atoms;

(ii) at least one acylated, nitrogen-containing compound having a substituent of at least 10 aliphatic carbon atoms made by reacting a carboxylic acid acylating agent with at least one amino compound containing at least one

—NH— group, said acylating agent being linked to said amino compound through an imido, amido, amidine, or acyloxy ammonium linkage;

(iii) at least one nitrogen-containing condensate of a phenol or aldehyde, and an amino compound having at least one

—NH— group;

(iv) at least one ester of a substituted carboxylic acid;

(v) at least one polymeric dispersant;

(vi) at least one hydrocarbon substituted phenolic dispersant; and (vii) at least one fuel soluble alkoxylated derivative of an alcohol, phenol, or amine.

8. The composition of claim 7, wherein the hydrocarbon soluble or dispersible alkali metal or alkaline earth metal salt is the sulfonate salt.

9. The composition of claim 7, wherein the weight ratio of (B) to the ashless dispersant (E) is about 2:1 to about 1:50.

10. The composition of claim 9, wherein the molecular weight of (B) (ii) is about 400 to about 10,000.

11. The composition of claim 1, wherein the weight percent of the ethylene oxide in the copolymer is from 10% to 90%.

12. The composition of claim 1, wherein the hydrocarbyl group of (B) (i) is polyisobutylene.

13. The composition of claim 1 wherein B(iii) is a hydrocarbyl substituted phenol wherein the hydrocarbyl groups contain a total of about 10 to 30 carbon atoms.

14. The composition of claim 1, wherein the (A) is a neutral salt.

15. The composition of claim 1, wherein the monohydric alcohol is a mixture of t-butanol and methanol.

16. The composition of claim 1, wherein (B) (i) is the ammonium salt thereof.

17. A fuel composition comprising:

(B) a mixture of:

(i) a hydrocarbon substituted sulfonated phenol or salt thereof;

(ii) an ethylene oxide/propylene oxide copolymer; and (iii) a hydrocarbyl substituted phenol, the weight ratio of component (B) (i) to (B) (ii) is from about 10:1 to about 1:10 and the weight ratio of component (B) (i) to (B) (iii) is from about 8:1 to about 1:8

(C) low lead or no lead gasoline;

(D) at least on alcohol wherein the alcohol is monohydric containing up to 8 carbon atoms; and, (E) at least one ashless dispersant selected from the group consisting of:

(i) at least one hydrocarbyl-substituted amine wherein the hydrocarbyl substituent is aliphatic and contains at least 8 carbon atoms;

(ii) at least one acylated, nitrogen-containing compound having a substituent of at least 10 aliphatic carbon atoms made by reacting a carboxylic acid acylating agent with at least one amino compound containing at least one

—NH— group, said acylating agent being linked to said amino compound through an imido, amido, amidine, or acyloxy ammonium linkage;

(iii) at least one nitrogen-containing condensate of a phenol or aldehyde and an amino compound having at least one

—NH— group;

(iv) at least one ester of a substituted carboxylic acid;

(v) at least one polymeric dispersant;

(vi) at least one hydrocarbon substituted phenolic dispersant; and (vii) at least one fuel soluble alkoxylated derivative of an alcohol, phenol, or amine.

18. The composition of claim 17 wherein the weight percent ethylene oxide in the copolymer is about 10% to about 90%.

19. The composition of claim 17, wherein the ashless dispersant is (E) (ii).

20. The composition of claim 17 additionally containing a hydrocarbyl substituted phenol wherein the hydrocarbyl groups contain a total of about 10 to 30 carbon atoms.

21. A process for delivering low lead or no lead gasoline containing an alkali metal or alkaline earth metal containing composition with enhanced water tolerance to a vehicle fuel tank including the steps of combining with the gasoline;

(A) a hydrocarbon-soluble or dispersible alkali earth metal or alkaline earth metal containing composition, and (B) a mixture of:

(i) a hydrocarbon substituted sulfonated phenol or salt thereof;

(ii) an ethylene oxide/propylene oxide copolymer; and (iii) a hydrocarbyl substituted phenol, the weight of component (B) (i) to (B) (ii) is from about 10:1 to about 1:10 and the weight ratio of component (B) (i) to (B) (iii) is from about 8:1 to about 1:8 and such that the weight ration of (A) to (B) is sufficient to impart enhanced water tolerance to the mixture of (A) and (B).

22. The process of claim 21 further comprising the steps of adding (E) an ashless dispersant selected from the group consisting of:

(i) at least one hydrocarbyl-substituted amine wherein the hydrocarbyl substituent is aliphatic and contains at least 8 carbon atoms;

(ii) at least one acylated, nitrogen-containing compound having a substituent of at least 10 aliphatic carbon atoms made by reacting a carboxylic acid acylating agent with at least one amino compound containing at least one

—NH— group, said acylating agent being linked to said amino compound through an imido, amido, amidine, or acyloxy ammonium linkage;

(iii) at least one nitrogen-containing condensate of a phenol or aldehyde and an amino compound having at least one

—NH— group;

(iv) at least one ester of a substituted carboxylic acid;

(v) at least one polymeric dispersant;

(vi) at least one hydrocarbon substituted phenolic dispersant; and (vii) at least one fuel soluble alkoxylated derivative of an alcohol, phenol, or amine.

* * * * *